US012325605B2

(12) United States Patent
Bartolini et al.

(10) Patent No.: US 12,325,605 B2
(45) Date of Patent: Jun. 10, 2025

(54) METHOD AND A MACHINE FOR WINDING A WEB ONTO SPOOLS TO FORM A SUCCESSION OF WEB REELS

(71) Applicant: VALMET AB, Sundsvall (SE)

(72) Inventors: Fabrizio Bartolini, Lucca (IT); Marco Capitani, Lucca (IT)

(73) Assignee: VALMET AB, Sundsvall (SE)

( * ) Notice: Subject to any disclaimer, the term of this patent is extended or adjusted under 35 U.S.C. 154(b) by 226 days.

(21) Appl. No.: 18/251,750

(22) PCT Filed: Nov. 18, 2021

(86) PCT No.: PCT/EP2021/082088
§ 371 (c)(1),
(2) Date: May 4, 2023

(87) PCT Pub. No.: WO2022/128305
PCT Pub. Date: Jun. 23, 2022

(65) Prior Publication Data

US 2023/0416036 A1 Dec. 28, 2023

(30) Foreign Application Priority Data

Dec. 14, 2020 (SE) ..... 2051451-9

(51) Int. Cl.
*B65H 18/26* (2006.01)
*B65H 18/20* (2006.01)
(Continued)

(52) U.S. Cl.
CPC ..... *B65H 19/2261* (2013.01); *B65H 18/20* (2013.01); *B65H 18/26* (2013.01);
(Continued)

(58) Field of Classification Search
CPC .... B65H 19/26; B65H 19/2261; B65H 18/20; B65H 18/26; B65H 18/025
See application file for complete search history.

(56) References Cited

U.S. PATENT DOCUMENTS 5,544,841 A 8/1996 Didier et al.
5,577,685 A 11/1996 Junk
(Continued)

FOREIGN PATENT DOCUMENTS

EP 1713706 B1 4/2011
WO WO-2002/034655 A1 5/2002
(Continued)

OTHER PUBLICATIONS

International Searching Report and Written Opinion for International Application No. PCT/EP2021/082088, dated Nov. 18, 2021, (11 pages), European Patent Office, Rijswijk, Netherlands.

*Primary Examiner* — Sang K Kim
(74) *Attorney, Agent, or Firm* — Alston & Bird LLP

(57) ABSTRACT

A device and method of winding a web (W) of tissue paper or a non-woven material onto spools (2) to form a succession of web reels (3) on the spools (2) wherein the force in the winding nip (5) is measured and, as the diameter of the web reel (3) grows, the spool (2) on which the web reel (3) is wound is moved during winding along a horizontal plane such that, in the horizontal direction, the distance between the first supporting drum (4) and the spool (2) increases, and the second supporting drum (9) is moved vertically downwards to match the increasing size of the web reel (3) while maintaining contact with the web reel (3) to such an extent that a nip force between the web reel (3) and the second supporting drum (9) is maintained, and the first supporting drum (4) is moved vertically downwards as the diameter of the web reel (3) grows and moved to such an extent that the measured nip force in the winding nip (5) remains substantially at a set value or within the range of a predetermined upper and a predetermined lower value.

22 Claims, 6 Drawing Sheets

(51) Int. Cl.
*B65H 19/22* (2006.01)
*B65H 19/26* (2006.01)

(52) U.S. Cl.
CPC ... *B65H 19/26* (2013.01); *B65H 2301/41376* (2013.01); *B65H 2404/4211* (2013.01)

(56) References Cited

U.S. PATENT DOCUMENTS

| | | | | |
|---|---|---|---|---|
| 5,611,500 | A * | 3/1997 | Smith | B65H 18/26 242/542.3 |
| 5,690,298 | A | 11/1997 | Rück | |
| 5,895,007 | A | 4/1999 | Moller et al. | |
| 5,931,406 | A | 8/1999 | Siebert | |
| 5,967,440 | A | 10/1999 | Marshall | |
| 5,988,557 | A | 11/1999 | Möller et al. | |
| 6,129,305 | A | 10/2000 | Möller et al. | |
| 6,328,248 | B1 * | 12/2001 | Kaipf | B65H 19/267 242/526.1 |
| 6,427,938 | B1 * | 8/2002 | Madrzak | B26D 1/045 242/526.3 |
| 7,017,855 | B2 | 3/2006 | Kojo et al. | |
| 2008/0251628 | A1 * | 10/2008 | Kemppainen | B65H 18/22 242/542.3 |

FOREIGN PATENT DOCUMENTS

| | | | |
|---|---|---|---|
| WO | WO-2004/080870 | A1 | 9/2004 |
| WO | WO-2009/109503 | A1 | 9/2009 |

* cited by examiner

METHOD AND A MACHINE FOR WINDING A WEB ONTO SPOOLS TO FORM A SUCCESSION OF WEB REELS

CROSS REFERENCE TO RELATED APPLICATIONS

This application is a National Stage Application, filed under 35 U.S.C. § 371, of International Application No. PCT/EP2021/082088, filed Nov. 18, 2021, which international application claims priority to and the benefit of Swedish Application No. 2051451-9, filed Dec. 14, 2020; the contents of both of which as are hereby incorporated by reference in their respective entireties.

BACKGROUND

Related Field

The present invention relates to a method of winding a web of tissue paper or a non-woven material onto spools to form a succession of web reels on the spools. The invention also relates to a winding machine for carrying out the method.

Description of Related Art

In in-line or off-line winders for tissue paper webs and non-wovens, it is desirable that the winding nip force in the winding nip be kept even during the winding process and that vibrations be avoided. U.S. Pat. No. 5,931,406 discloses a winder for the continuous winding of a material web such as a paper or board web. The winder has a contact pressure drum which forms a winding nip with the wound reel and is rotatably arranged on a lifting table which can be displaced vertically or substantially vertically and has a guide for the spools which comprise guide rails. Other winders are known from, for example, U.S. Pat. Nos. 7,017,855; 5,988,557; 5,967,440; 6,129,305; 5,544,841; WO 2009/109503; WO 2004/080870; and EP 1713706 B1. It is an object of the present invention to provide an improved method and machine for winding of a tissue paper web which provides good stability during winding and offers a possibility to reduce vibrations. A further object of the invention is to provide improved caliper and density control of web reels. Yet another object of the invention is to offer improved flexibility such that the machine can be suitable for optimizing the process for different products.

BRIEF SUMMARY

The invention relates to a method of winding a web of tissue paper web or non-woven material onto spools to form a succession of web reels on the spools. For each web reel that is wound, the web is guided over a part of the circumference of a first supporting drum and through a winding nip formed between the first supporting drum and the web reel that is being wound. The first supporting drum acts against the web reel such that a winding nip force is generated in the winding nip. The web reel that is being wound is supported during winding also by a second supporting drum that is arranged to form a nip with the web reel that is being wound. According to the invention, the winding nip force in the winding nip is measured and, as the diameter of the web reel grows, the spool on which the web reel is wound is moved during winding along a horizontal plane such that, in the horizontal direction, the distance between the first supporting drum and the spool increases. The second supporting drum is moved vertically downwards to match the increasing size of the web reel while maintaining contact with the web reel to such an extent that a nip force between the web reel and the second supporting drum is maintained, and the first supporting drum is moved vertically downwards as the diameter of the web reel grows and moved to such an extent that the measured winding nip force in the winding nip remains substantially constant at a set value or remains within the range of a predetermined upper and a predetermined lower value.

In some embodiments, any set value or predetermined upper and lower values may be set to increase during the winding of each web reel by an amount equal to or greater than 3% and equal to or less than 10% from the beginning of the winding of a web reel until the web reel is completed.

In other embodiments, any set value or predetermined upper and lower values may be set to decrease during the winding of each web reel by an amount equal to or greater than 3% and equal to or less than 10% from the beginning of the winding of a web reel until the web reel is completed.

In yet other embodiments, the predetermined upper and lower values may be set in relation to a fixed set value. In such embodiments, the winding nip force in the winding nip will be held substantially constant during winding.

In advantageous embodiments, the method may be carried out such that, from at least the point in time at which a web reel has reached 20% of its final diameter until at least the point in time at which the same web reel has reached 95% of its final diameter, the angle between the horizontal plane and a straight line from the axis of rotation of the first supporting drum and the axis of rotation of the web reel is kept constant. The angle preferably lies in the range equal to or greater than 40° and equal to or less than 50° and it is most preferred that the angle is 45°.

Preferably, but not necessarily, the nip force between the web reel and the second supporting drum is measured and compared to a set value and the second supporting drum is moved vertically if the measured nip force deviates from the set value by more than a preset allowable amount of deviation. The vertical movement continues until the measured nip force does not deviate from the set value by more than the preset allowable amount of deviation. This preset allowable amount of deviation is preferably less than or equal to 4%, and more preferably less than or equal to 2%.

Preferably, the method is carried out such that each spool rotates about an axis of rotation during winding and the first supporting drum rotates about an axis of rotation which, during the entire winding process, is located at a vertical level which is below that of the axis of rotation of the spool.

In many advantageous embodiments, the method may be carried out such that, as the web reel moves along the horizontal plane, the second supporting drum also moves horizontally to follow the web reel such that the angle between the horizontal plane and a straight line from the axis of rotation of the second supporting drum and the axis of rotation of the web reel remains substantially constant at least from the point in time at which the web reel has reached 25% of its final diameter until at least the point in time at which the web reel has reached 95% of its final diameter.

Advantageously, the method may be performed such that, when a first web reel that is being wound has reached a predetermined size and it is time to start winding of a second web reel, the first supporting drum moves vertically upwards to engage a new spool, the web is cut at a point before it has reached the first web reel, and the second supporting drum is caused to act as a brake against the first web reel to reduce or stop the rotation of the web reel. In such embodiments in which the second supporting drum acts as a brake, the method may advantageously be carried out in such a way that, after the second supporting drum has acted as a brake against the first web reel, the second supporting drum is caused to move horizontally and vertically until it comes into contact with the second web reel and starts to support the second web reel.

Advantageously, the method may also be carried out such that, at least from the point in time at which the web reel has reached 25% of its final diameter until at least the point in time at which the web reel has reached 90% of its final diameter, the second supporting drum is caused to move in the horizontal direction during winding as the spool moves such that the position of the second supporting drum in the horizontal direction remains substantially constant in relation to that of the spool of the web reel that is being wound.

In embodiments of the invention, the method is carried out such that the spool of the web reel that is being wound rotates about an axis of rotation and the second supporting drum also rotates about an axis of rotation and the axes of rotation of the spool and the second supporting drum are kept in the same vertical plane at least from the point in time at which the web reel has reached 25% of its final diameter until at least the point in time at which the web reel has reached 90% of its final diameter.

In other embodiments, the method is carried out such that the spool of the web reel that is being wound rotates about an axis of rotation and the second supporting drum also rotates about an axis of rotation and the axes of rotation of the spool and the second supporting drum are not kept in the same vertical plane. Instead, a straight line between the two axes may form an angle to a vertical plane at least from the point in time at which the web reel has reached 25% of its final diameter until at least the point in time at which the web reel has reached 90% of its final diameter. The angle between a vertical plane and straight line between the axes of rotation of the spool and the second support drum may be in the range equal to or greater than 5° and equal to or less than 80°, preferably in the range equal to or greater than 15° and equal to or less than 60° and even more preferred in the range equal to or greater than 25° and equal to or less than 50°. For example, the angle may be 45°.

Advantageously, when a first web reel that is being wound has reached a predetermined size and it is time to start winding of a second web reel, the first supporting drum is moved vertically upwards, a new reel spool for the second web reel is caused to move into a position in which it is supported from below by the first supporting drum.

When the first supporting drum is caused to change its vertical position, this may advantageously be made continuously as the diameter of the web reel grows.

Possibly, also when the second supporting drum is caused to change its position, this can be done continuously as the diameter of the web reel grows.

The method may be carried out such that the nip force in the nip between the web reel and the second supporting drum is preferably caused to increase during winding by an amount which is equal to or greater than 15% and equal to or less than 30% of the nip force from the beginning of the winding of a web reel to the end of the winding when the web reel has reached its final diameter and more preferably caused to increase by an amount which is equal to or greater than 20% and equal to or less than 28% of the nip force at the beginning.

The invention also relates to a winding machine for winding a web of tissue paper or a non-woven material onto spools to form a succession of web reels on the spools. The inventive winding machine comprises a first supporting drum arranged to act against a web reel in a winding nip and the first supporting drum is moveable upwards and downwards in the vertical direction. A first actuator is functionally connected to the first supporting drum to be capable of moving the first supporting drum in the vertical direction. The machine further comprises a guide rail structure along which web reels can move in a horizontal direction as their diameter increases. A second supporting drum is arranged to be capable of acting against the web reel to form a nip against the web reel. The second supporting drum is moveable both horizontally and vertically. Suitably, a second actuator is functionally connected to the second supporting drum such that it can cause the second supporting drum to move vertically and horizontally. According to the invention, the machine further comprises a logic control unit which logic control unit is connected to the first actuator and capable of controlling the first actuator. At least one winding nip force sensor is arranged to measure the force in the winding nip and send a signal to the logic control unit which is indicative of the force in the winding nip. The logic control unit comprises software with an instruction to compare a set value for the force in the winding nip with the signal from the at least one winding nip force sensor and send an instruction to the first actuator to move the first supporting drum in the direction necessary to correct any deviation from the set force if the signal from the winding force nip sensor indicates that the winding nip force in the winding nip deviates from the set value or is outside the range of a predetermined lower value and a predetermined higher value.

The set value may be a fixed set value for the force in the winding nip or it may be allowed to change during winding as a function of the web diameter. In such embodiments, the diameter is calculated by the logic control unit as a function of machine speed, time and web thickness.

Optionally and advantageously, the machine may further comprise at least one nip force sensor arranged to measure the nip force in the nip between the second supporting drum and the web reel and send a signal to the logic control unit which is indicative of the nip force between the second supporting drum and the web reel. The logic control unit then comprises software with an instruction to compare a set value for the nip force in the nip between the second supporting drum and the web reel with the signal from the at least one nip force sensor and send an instruction to an actuator to move the second supporting drum in the direction necessary to correct any deviation from the set force if the signal from the sensor indicates that the nip force is outside the range of a predetermined lower value and a predetermined higher value.

Preferably, the machine further comprises a cutting device for cutting the web when a new web reel is to be wound. It should be understood however, that the machine may be delivered to a mill (for example a tissue paper mill) from a machine manufacturer without such a cutting device and leave it to the operator of the mill to install a cutting device.

DETAILED DESCRIPTION OF VARIOUS EMBODIMENTS

Figure 1:
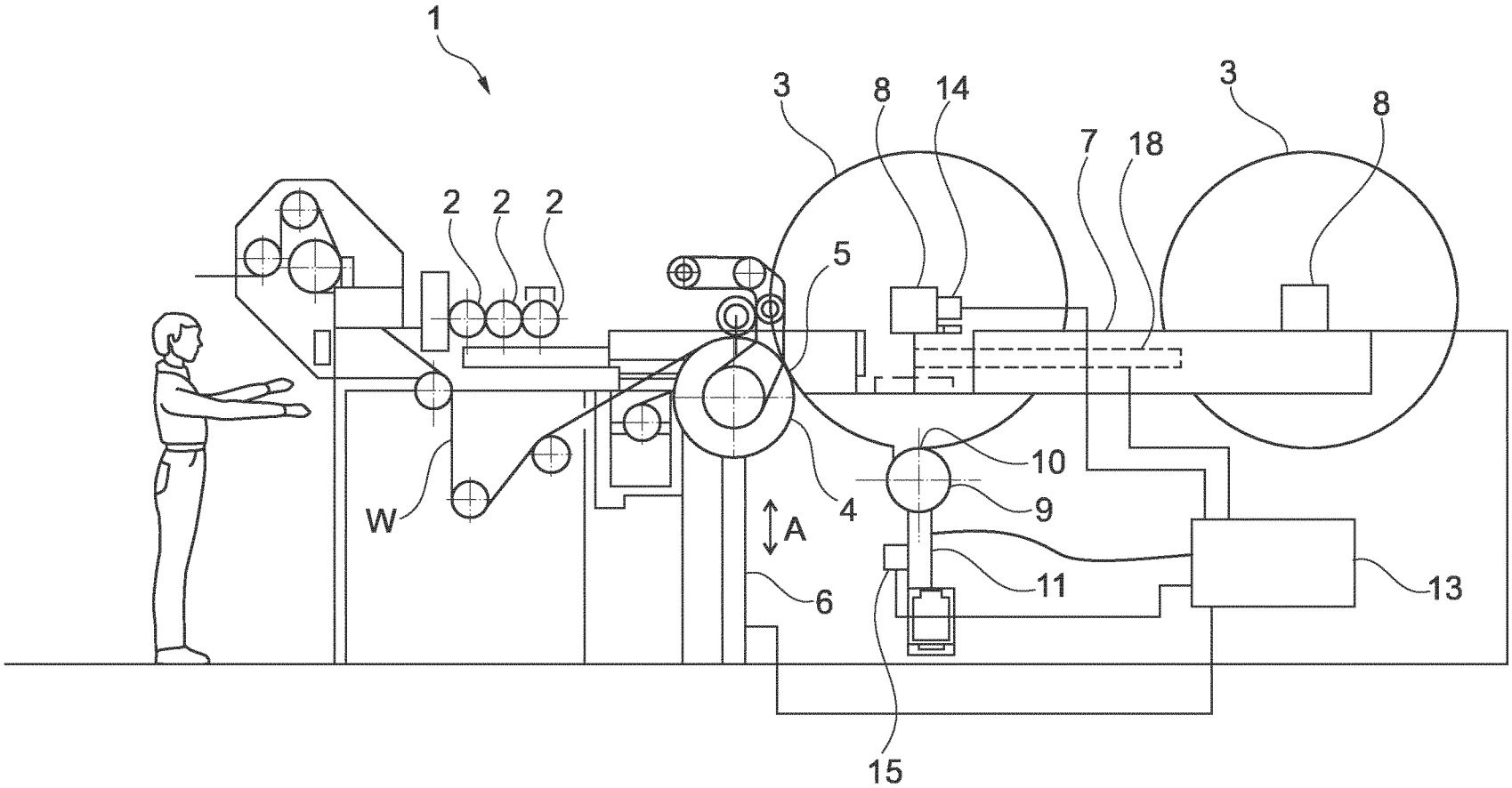
FIG. 1 is a side view giving a general overview of a winding machine according to the present invention.
Figure 14:
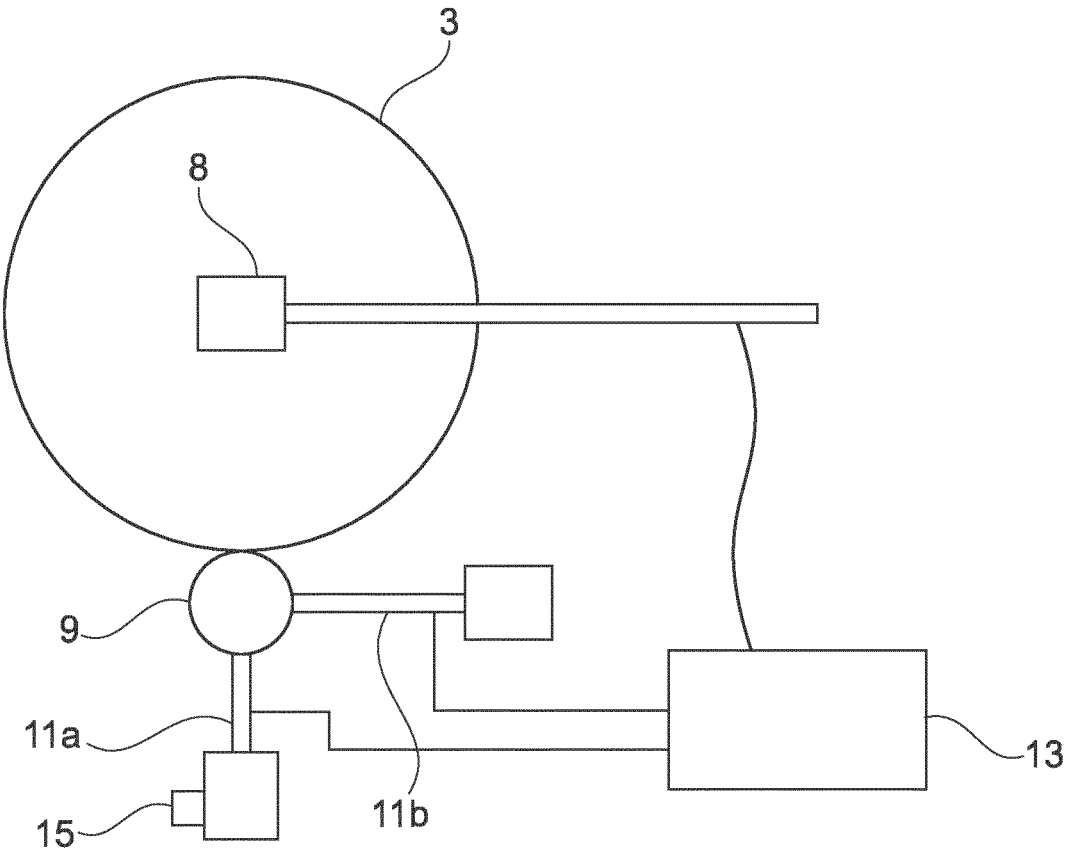
FIG. 14 is a schematic representation of a control system for the second supporting drum.

With reference to FIG. 1, a winding machine 1 according to the present invention for winding a tissue paper web or a web of a non-woven material onto spools 2 to form a succession of web reels on the spools 2 is shown. The winding machine 1 comprises a first supporting drum 4 which is arranged to act against a web reel 3 in a winding nip 5. The first supporting drum is arranged to be moveable upwards and downwards in the vertical direction as indicated by arrow A. A first actuator 6 is functionally connected to the first supporting drum 4 to be capable of moving the first supporting drum 4 in the vertical direction. The machine also comprises a guide rail structure 7 along which web reels 3 can move in a horizontal direction as their diameter increases. A second supporting drum 9 is arranged to be capable of acting against the web reel 3 and form a nip 10 against the web reel 3. The second supporting drum 9 can thereby contribute to increased stability during winding. The second supporting drum 9 is moveable both horizontally and vertically. The second supporting drum may be functionally connected to a second actuator 11 that is capable of causing the second supporting drum 9 to move vertically and horizontally. In FIG. 1, the second actuator 11 is only indicated schematically and it should be understood that it may take any form that is capable of providing vertical and horizontal movement. It should also be understood that the second actuator 11 may be composed of one actuator for horizontal movement and one for vertical movement. With reference to FIG. 14, an arrangement is schematically shown in which the second actuator 11 is composed of a vertical actuator 11*a* for moving the second supporting drum 9 vertically and a horizontal actuator 11*b* for moving the second supporting drum horizontally. According to the invention, the winding machine 1 further comprises a logic control unit 13. The logic control unit 13 is connected to the first actuator 6 and capable of controlling the first actuator 6. At least one winding nip force sensor 14 is arranged to measure the force in the winding nip 5 and send a signal to the logic control unit 13 which is indicative of the force in the winding nip 5. The winding nip force sensor 14 may be connected to chucks 8 for carrying the outer ends of the spool 2. The logic control unit 13 comprises software with an instruction to compare a set value for the force in the winding nip with the signal from the at least one winding nip force sensor 14 and send an instruction to the first actuator 6 to move the first supporting drum 4 in the direction necessary to correct any deviation from the set value if the signal from the winding force nip sensor 14 indicates that the winding nip force in the winding nip 5 deviates from a set value or is outside the range of a predetermined lower value and a predetermined higher value. Since the logic control unit 13 is connected to the actuators 6, 11*a* and 11*b* for the first supporting drum 4 and the second supporting drum 9, it is thus capable of controlling the movement of the first supporting drum 4 and the second supporting drum 9 and thereby also the winding nip force in the winding nip 5 and the nip force in the nip 10 between the second supporting drum and the web reel 3. The value of the winding nip force in the winding nip 5 may vary depending on the circumstances of each individual case. Of course, all other things being equal, a wider wed reel will require a higher winding nip force than a narrower web reel. If the force is expressed not as an absolute value but in terms of linear load, a typical value in many practical cases may be 0.9-1.1 kN/m. For example, it may be 0.98 kN/m. However, other values are also conceivable, both higher and lower.

The set value may be a fixed set value, but it may alternatively also be allowed to change during winding as a function of the web diameter and the diameter is calculated by the logic control unit 13 as a function of machine speed, time and web thickness.

Preferably, the machine 1 further comprises at least one nip force sensor 15 that is arranged to measure the force in the nip 10 between the second supporting drum 9 and the web reel 3 and to send a signal to the logic control unit 13 which is indicative of the nip force between the second supporting drum 9 and the web reel 3. The logic control unit 13 may then comprise software with an instruction to compare a set value for the force in nip between with the signal from the at least one nip force sensor 15 and send an instruction to an actuator (for example the second actuator 11) to move the second supporting drum 9 in the direction necessary to correct any deviation from the set value if the signal from the sensor 15 indicates that the nip force deviates from a set value or is outside the range of a predetermined lower value and a predetermined higher value.

The machine preferably also further comprises a cutting device 16 for cutting the web when a new web reel 3 is to be wound.

Figure 2B:
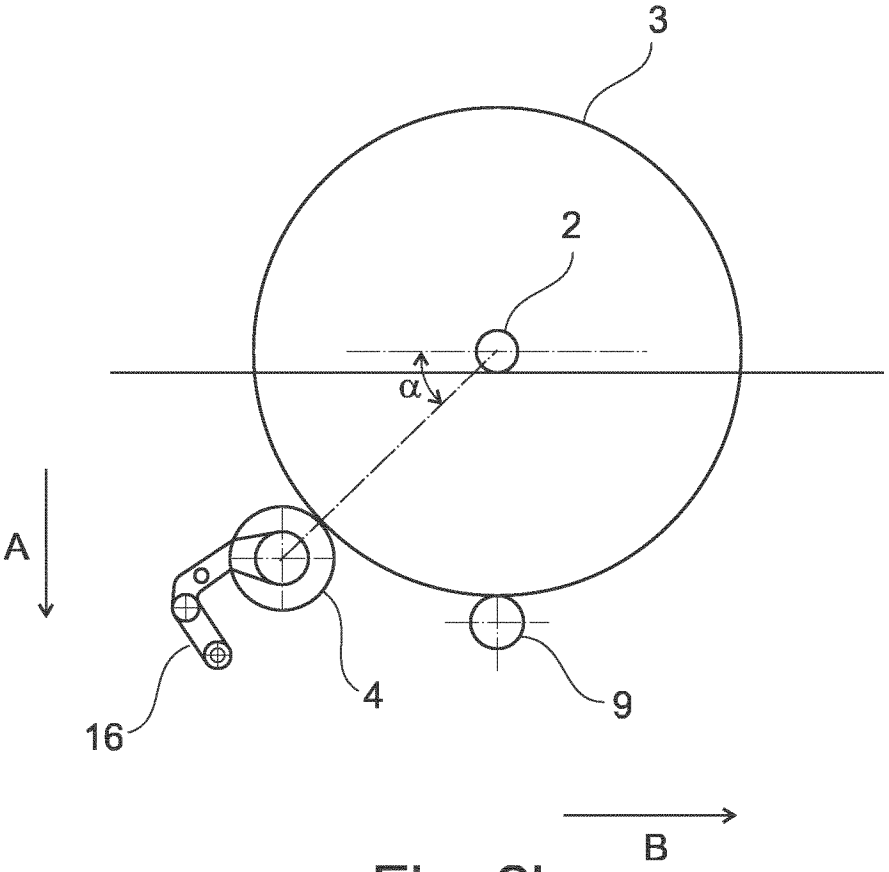
FIG. 2*b* is a view similar to FIG. 2*a* but showing a part of the reeling sequence at a second point in time.
Figure 2A:
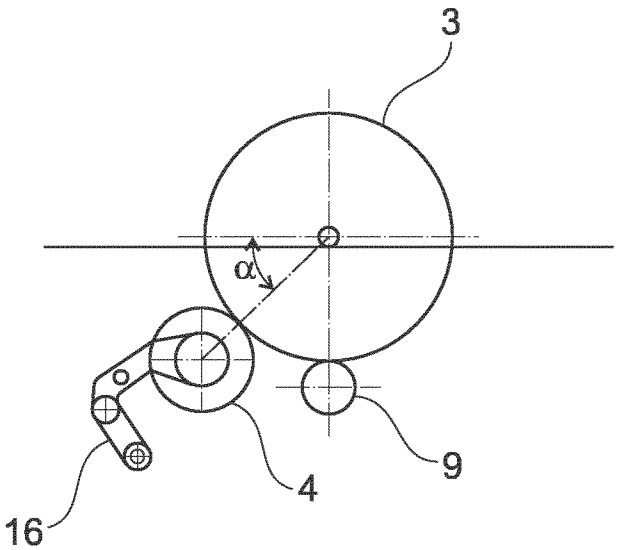
FIG. 2*a* shows a part of a reeling sequence according to the invention at a first point in time.

A method according to the invention for winding a web W onto spools 2 to form a succession of web reels 3 on the spools 2 will now be explained with reference first to FIG. 1, FIG. 2*a* and FIG. 2*b*. As best seen from FIG. 1, the web W is guided over a part of the circumference of the first supporting drum 4 for each web reel 3 that is wound. The web W is then guided through the winding nip 5 formed between the first supporting drum 4 and the web reel 3 that is being wound. The first supporting drum 4 acts against the web reel 3 such that a force is generated in the winding nip 5. The web reel 3 that is being wound is supported during winding also by the second supporting drum 9 that is arranged to form a nip 10 with the web reel 3 that is being wound. During winding, the force in the winding nip 5 is measured (for example by means of the at least one winding nip force sensor 14). As the diameter of the web reel 3 grows, the spool 2 on which the web reel 3 is wound is moved during winding along a horizontal plane such that, in the horizontal direction, the distance between the first supporting drum 4 and the spool 2 increases. In FIG. 2*a*, a web reel 3 is shown at a first point in time at which the web reel 3 has reached a certain diameter. In FIG. 2*b*, the same web reel 3 is seen at a later point in time at which the diameter of the web reel 3 has become large and the distance in the horizontal direction between the first supporting drum 4 and the spool 2 has increased. To accommodate for the increased diameter and the movement of the spool 2 in the horizontal direction, the second supporting drum 9 has been moved horizontally as indicated by arrow B and also vertically downwards as indicated by the arrow A such that its position matches the increased size of the web reel 3 but it still maintains contact with the web reel 3 to such an extent that a nip force between the web reel 3 and the second supporting drum 9 is maintained. The first supporting drum 4 has also been moved vertically downwards as the diameter of the web reel 3 grows as indicated by arrow A. It has moved to such an extent that the measured force in the winding nip 5 remains within the range of a predetermined upper and a predetermined lower value.

During the winding of each web reel 3, the predetermined upper and lower values may be set to follow a curve such that the increase by an amount equal to or greater than 3% and equal to or less than 10% from the beginning of the winding of a web reel 3 until the web reel 3 is completed or such that they decrease by an amount equal to or greater than 3% and equal to or less than 10% from the beginning of the winding of a web reel 3 until the web reel 3 is completed.

During winding, the web reel 3 is carried by the guide rail structure 7. However, as the web reel 3 grows in size, the weight of the web reel 3 may cause bending of the spool 2 which may increase the load on the second supporting drum 9. To compensate for this, the force in the winding nip 5 may be allowed to change as the web reel 3 grows in size.

However, the predetermined upper and lower values may also be set in relation to a fixed set value. This corresponds to a control in which it is attempted to correct the winding nip force as soon as it deviates from a fixed set value but in which minor deviations may be accepted.

For example, as the diameter of the web reel 3 grows, the first supporting drum 4 can be moved downwards such that the winding nip force in the winding nip 5 remains within a range of 2% deviation from a fixed set value.

As indicated in FIG. 2*a* and FIG. 2*b*, the angle $\alpha$ between the horizontal plane and a straight line from the axis of rotation of the first supporting drum 4 and the axis of rotation of the web reel 3 is remains constant (i.e. the axis of rotation of the spool 2). The method is preferably carried out at a constant angle $\alpha$ from at least the point in time at which a web reel 3 has reached 20% of its final diameter until at least the point in time at which the same web reel 3 has reached 95% of its final diameter. The angle $\alpha$ preferably lies in the range equal to or greater than 40° and equal to or less than 50° and is most preferably 45°.

Preferably but not necessarily, the nip force between the web reel 3 and the second supporting drum 9 is measured and compared to a set value while the second supporting drum 9 is moved vertically if the measured nip force deviates from a set value and moved until the measured nip force does not deviate from the set value by more than 4%, preferably not by more than 2%. Since increasing weight of the web reel 3 during winding may result in bending of the spool 2, the nip force in the nip 10 between the web reel 3 and the second supporting drum may be allowed to increase during winding. In many practical cases, the nip force between the second supporting drum 9 and the web reel may be allowed to increase by an amount equal to or greater than 15% and equal to or less than or 30% or an amount equal to or greater than % and equal to or less than or 28% of the nip force at the beginning of the winding from the nip force at the beginning of the winding (when the weight of the web reel is small) to the end of the winding when the web reel has reached its final diameter. For example, it may be allowed to increase by 25% or about 25%. To this end, the logic control unit 13 may comprise software that, during operation of the winding machine, controls movement of the second supporting drum 9 such that the nip force in the nip 10 between the second supporting drum 9 and the web reel 3 to increase by an amount which is equal to or greater than 15% and equal to or less than 30% of the nip force at the beginning of the winding from the nip force the beginning of the winding to the end of the winding of a web reel 3. In that case, the nip force in the nip 10 between the second supporting drum 9 and the web reel 3 will follow a curve instead of being kept at a constant level. Therefore, the method may be carried out such that the nip force in the nip 10 between the web reel 3 and the second supporting drum 9 is caused to increase during winding by an amount which is equal to or greater than 15% and equal to or less than 30% of the nip force at the beginning of the winding from the nip force at the beginning of the winding of a web reel 3 to the end of the winding when the web reel has reached its final diameter and preferably caused to increase by an amount which is equal to or greater than 20% and equal to or less than 28% of said nip force at the beginning of the winding. This can be controlled by the logic control unit 13 and the logic control unit may thus comprise software with an instruction to cause the nip force in the nip 10 between the web reel 3 and the second supporting drum 9 to increase during winding by an amount which is equal to or greater than 15% and equal to or less than 30% of the nip force at the beginning of the winding from the nip force at the beginning of the winding of a web reel 3 to the end of the winding when the web reel has reached its final diameter. The logic control unit 13 can achieve this effect since it controls the vertical movement of the second supporting drum through the vertical component 11*a* of the second actuator 11.

Each spool 2 rotates about an axis of rotation during winding. Preferably, the winding process is carried out such that the first supporting drum 4 rotates about an axis of rotation which, during the entire winding process, is located at a vertical level below that of the axis of rotation of the spool 2. The first supporting drum 4 will then be supporting the web reel at least partially from below during the entire winding process.

Preferably, a method according to the invention is carried out such that, as the web reel 3 moves along the horizontal plane, the second supporting drum 9 also moves horizontally to follow the web reel 3 such that a straight line from the axis of rotation of the second supporting drum 9 and the axis of rotation of the web reel 3 remains at a constant angle to the horizontal plane at least from the point in time at which the web reel 3 has reached 25% of its final diameter until at least the point in time at which the web reel 3 has reached 95% of its final diameter. The final diameter may vary depending on a number of factors such as, for example, the material of the web or the intended final product. In many typical cases, the final diameter may be on in the range of 3-4 m for a web reel formed by a tissue paper web but the value of the final diameter may also take other numerical values, both less than 3 m and more than 4 m. Often, the final diameter could be 3.5 m or 3.6 m. If the web material is a non-woven material, the final diameter may be in the range of 1 m-3 m. A typical value could be, for example, 1.2 m or 1.5 m. However, both for tissue paper and for non-wovens, the final diameter may deviate from the values given here and those values should only be understood as some typical examples. The axial width of a web reel made from a tissue paper web may be 5.6 m-6.0 m but other widths are also possible, both widths less than 5.6 m and widths greater than 6 m. The axial width of a web reel made from a non-woven material may take many different numerical values, but typical values would often be in the range of 2.2 m-5 m. It should be understood that the axial width of the web reel may take other numerical values.

Figure 3:
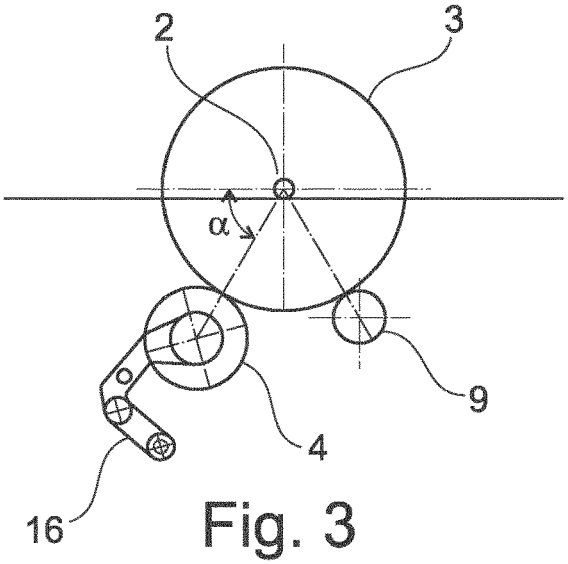
FIG. 3 shows winding in a machine configuration that differs from that of FIG. 1.

FIG. 3 shows how the winding can be carried out in a somewhat different configuration compared to that of FIG. 2*a* and FIG. 2*b*. In the configuration of FIG. 3, the second supporting drum is not directly below the spool 2 but placed at an angle α which is the same angle as for the first supporting drum 4.

Figure 4:
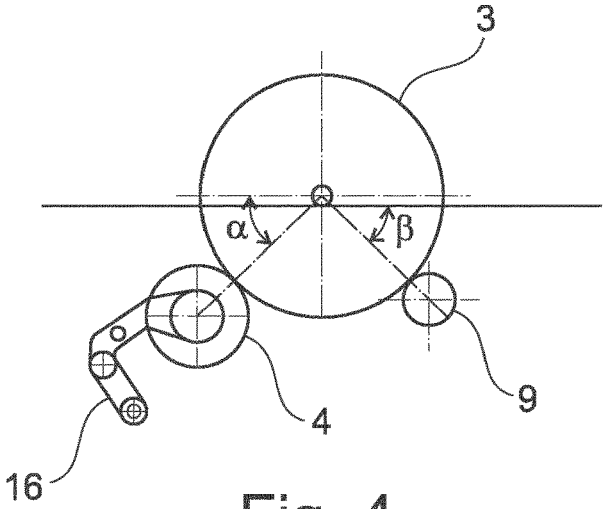
FIG. 4 shows a slight variation of the configuration of FIG. 3.

FIG. 4 shows a configuration similar to that if FIG. 3 but the angle α is here smaller than in FIG. 3 and may be about 45°. In the configuration of FIG. 4, the second supporting drum 9 is not located directly below the axis of rotation of the spool 2. Instead, a straight line between the axis of rotation of the second supporting drum 9 and the axis of rotation of the spool 2 forms an angle β with the horizontal plane which may be equal to the angle α, i.e. 45° or about 45°.

Figure 5:
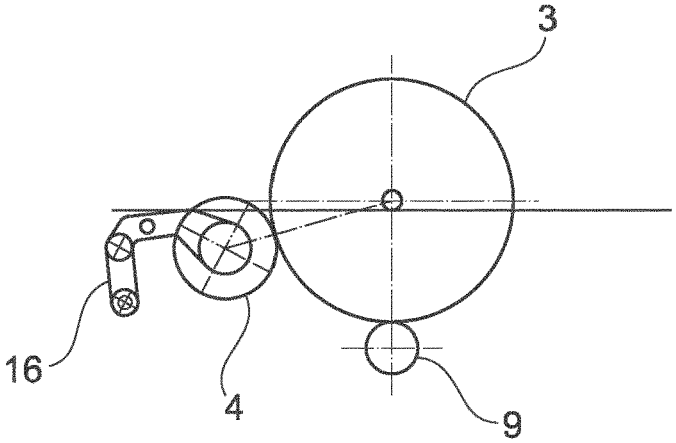
FIG. 5 shows yet another possible configuration.

FIG. 5 shows a running configuration in which the angle α for the first supporting drum is kept much smaller during operation and in which the second supporting drum is operating directly vertically below the spool 2.

The angle α between the horizontal plane and a straight line from the axis of rotation of the first supporting drum 4 and the axis of rotation of the web reel 3 can be kept constant, for example 45° but, for some applications, it may be suitable to change the angle α during the winding operation such that it decreases or increases during operation. The logic control unit can then comprise software that is designed to control the angle α during winding such that it changes according to a predetermined curve which is increasing or decreasing. This can be made dependent on the diameter of the web reel 3.

Doffing according to the invention, i.e. change of spool to make a new web reel 3 will now be explained with reference to FIGS. 6-13.

Figure 6:
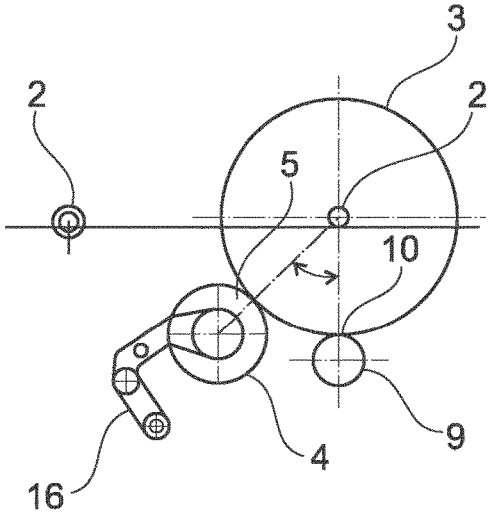
FIG. 6 shows a situation is shown in which a first web reel has reached a predetermined size and it is time to start winding of a second web reel.
Figure 7:
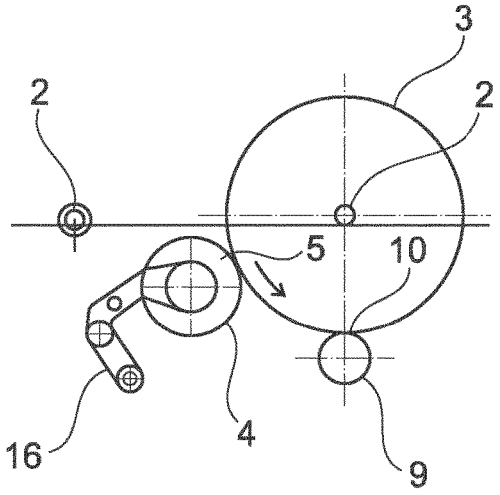
FIG. 7 is a figure similar to FIG. 6 but shows a step following the situation in FIG. 6.
Figure 8:
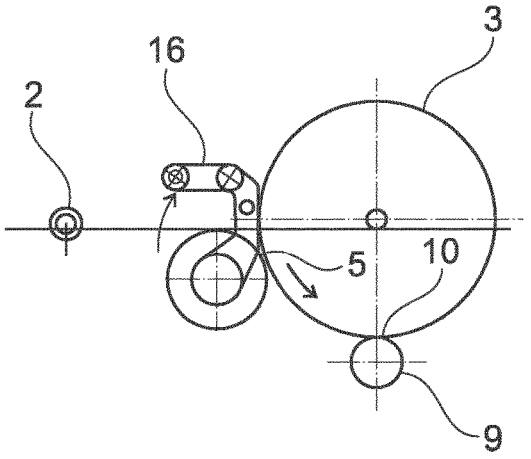
FIG. 8 shows a step following the situation as shown in FIG. 7.
Figure 9:
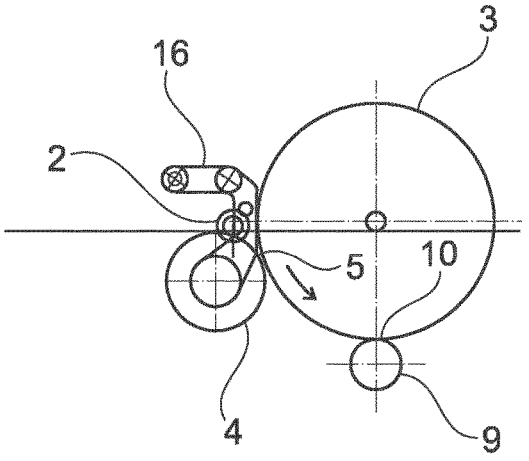
FIG. 9 shows a step following the situation as shown in FIG. 8.
Figure 10:
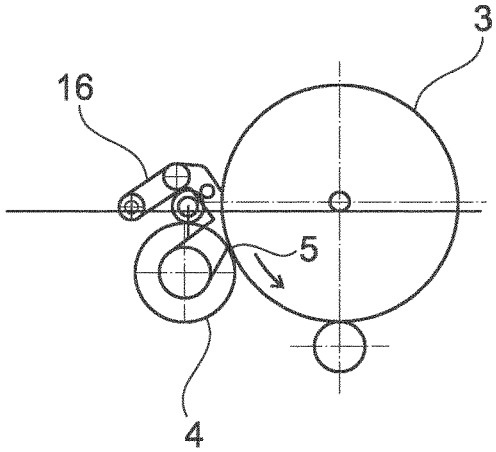
FIG. 10 shows a step following the situation as shown in FIG. 9.

In FIG. 6, a situation is shown in which a first web reel 3 that is being wound has reached a predetermined size and it is time to start winding of a second web reel. In FIG. 7, it can be seen how the first supporting drum 4 has been moved upwards to engage a new spool 2. With reference to FIG. 8, the cutting device 16 is moved into position. In FIG. 9, the new spool 2 has been moved forward into position. In FIG. 10, the web W is cut at a point before it has reached the first web reel 3. A blowing device may be employed to blow the web onto the new reel spool 2.

Figure 11:
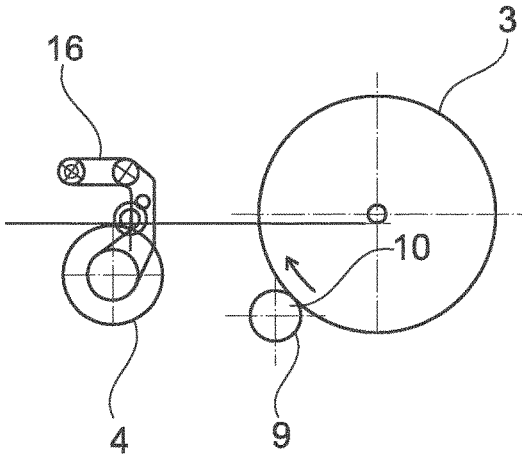
FIG. 11 shows a step following the situation as shown in FIG. 10.

In FIG. 11, the situation immediately after cutting is shown. The cutting device 16 has now opened and the second supporting drum 9 has been moved to a new position and is now caused to act as a brake against the first web reel 3 to reduce or stop the rotation of the web reel 3.

Figure 12:
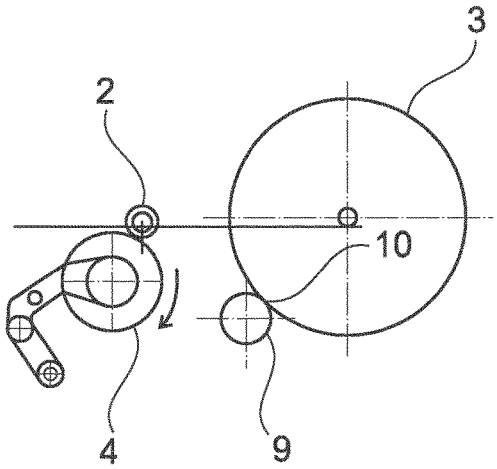
FIG. 12 shows a step following the situation as shown in FIG. 11.

In FIG. 12, the cutting device 16 has been moved back to an idle position and the web reel 3 has been stopped or its rotational speed has been reduced to a very low level.

Figure 13:
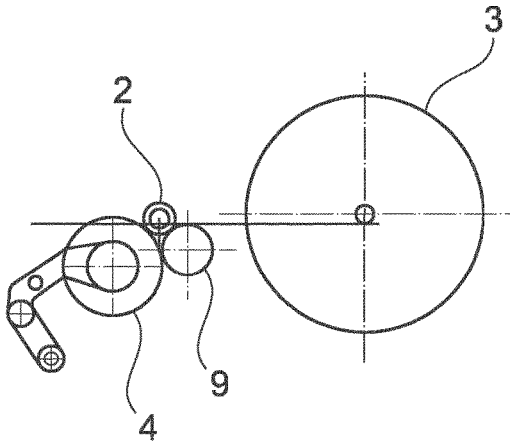
FIG. 13 shows the situation in which winding of one web reel has been completed and winding of the next reel is started.

In FIG. 13, it can be seen how the second supporting drum 9 has been moved horizontally and vertically such that it has come into contact with the second web reel 3. It can then start to support the second web reel 3.

In connection with doffing, the second supporting drum will change its position in the horizontal direction relative to the web reel 3 that is being wound. However, at least from the point in time at which the web reel 3 has reached 25% of its final diameter until at least the point in time at which the web reel 3 has reached 90% of its final diameter, the second supporting drum 4 should preferably be caused to move in the horizontal direction during winding as the spool 2 moves such that the position of the second supporting drum 9 in the horizontal direction remains constant in relation to that of the spool 2 of the web reel 3 that is being wound. Preferably, the axis of rotation of the spool 2 of the web reel 3 that is being wound and the axis of rotation of the second supporting 9 drum should be kept in the same vertical plane at least from the point in time at which the web reel 3 has reached 25% of its final diameter until at least the point in time at which the web reel 3 has reached 90% of its final diameter.

The inventive method and the inventive winding machine may be used both for on-line winding and off-line winding.

Thanks to the invention, the winding can be carried out with a high stability during the winding process. Different configurations of the machine are possible which allows the machine to be suitable for many different products.

Although the invention has been described above in terms of a method of winding and a winding machine, it should be understood that those categories only reflect different aspects of one and the same invention. The machine is thus designed to carry out the inventive method.

The invention claimed is:

1. A method of winding a web (W) of tissue paper or a non-woven material onto spools (2) to form a succession of web reels (3) on the spools (2) and wherein, for each web reel (3) that is wound, the web (W) is guided over a part of the circumference of a first supporting drum (4) and through a winding nip (5) formed between the first supporting drum (4) and the web reel (3) that is being wound, the first supporting drum (4) acting against the web reel (3) such that a nip force is generated in the winding nip (5), and wherein the web reel (3) that is being wound is supported during winding by a second supporting drum (9) that is arranged to form a nip (10) with the web reel (3) that is being wound, the method comprising the steps of:

measuring the force in the winding nip (5);

as the diameter of the web reel (3) grows, moving the spool (2) on which the web reel (3) is wound during winding along a horizontal plane such that, in the horizontal direction, the distance between the first supporting drum (4) and the spool (2) increases;

moving the second supporting drum (9) vertically downwards to match the increasing size of the web reel (3) while maintaining contact with the web reel (3) to such an extent that a nip force between the web reel (3) and the second supporting drum (9) is maintained; and moving the first supporting drum (4) vertically downwards as the diameter of the web reel (3) grows to such an extent that the measured nip force in the winding nip (5) remains substantially at a set value or within the range of a predetermined upper and a predetermined lower value.

2. The method according to claim 1, wherein, during the winding of each web reel (3), said set value or said predetermined upper and lower values are set to increase with an amount equal to or greater than 3% and equal to or less than 10% of the respective value at the beginning of the winding from the beginning of the winding of a web reel (3) until the web reel (3) is completed.

3. The method according to claim 1, wherein, during the winding of each web reel (3), said set value or said predetermined upper and lower values are set to decrease with an amount equal to or greater than 3% and equal to or less than 10% of the respective value at the beginning of the winding from the beginning of the winding of a web reel (3) until the web reel (3) is completed.

4. The method according to claim 1, wherein said predetermined upper and lower values are set in relation to a fixed set value.

5. The method according to claim 1, wherein, as the diameter of the web reel (3) grows, the first supporting drum (4) is moved downwards such that the winding nip force in the winding nip (5) remains within a range of 2% deviation from a fixed set value.

6. The method according to claim 1, wherein, from at least the point in time at which a web reel (3) has reached 20% of its final diameter until at least the point in time at which the same web reel (3) has reached 95% of its final diameter, the angle between the horizontal plane and a straight line from the axis of rotation of the first supporting drum (4) and the axis of rotation of the web reel (3) is kept constant.

7. The method according to claim 6, wherein the angle lies in the range equal to or greater than 40° and equal to or less than 50°.

8. The method according to claim 1, wherein the nip force between the web reel (3) and the second supporting drum (9) is measured and compared to a set value and wherein the second supporting drum (9) is moved vertically in the direction necessary to correct any deviation from the set force if the measured nip force deviates from the set value and is moved until the measured nip force does not deviate from the set value by more than 4%.

9. The method according to claim 1, wherein the nip force in the nip (10) between the web reel (3) and the second supporting drum is caused to increase during winding by an amount which is equal to or greater than 15% and equal to or less than 30% of said nip force at the beginning of the winding from the beginning of the winding of a web reel (3) to the end of the winding when the web reel has reached its final diameter.

10. The method according to claim 1, wherein each spool (2) rotates about an axis of rotation during winding and wherein the first supporting drum (4) rotates about an axis of rotation which, during the entire winding process, is located at a vertical level below that of the axis of rotation of the spool (2).

11. The method according to claim 1, wherein, as the web reel (3) moves along the horizontal plane, the second supporting drum (9) also moves horizontally to follow the web reel (3) such that the angle between the horizontal plane and a straight line from the axis of rotation of the second supporting drum (9) and the axis of rotation of the web reel (3) remains substantially constant at least from the point in time at which the web reel (3) has reached 25% of its final diameter until at least the point in time at which the web reel (3) has reached 95% of its final diameter.

12. The method according to claim 1, wherein, when a first web reel (3) that is being wound has reached a predetermined size and it is time to start winding of a second web reel, the first supporting drum (4) moves vertically upwards to engage a new spool (2), the web is cut at a point before it has reached the first web reel (3), and the second supporting drum (9) is caused to act as a brake against the first web reel (3) to reduce or stop the rotation of the web reel (3).

13. The method according to claim 12, wherein, after the second supporting drum (9) has acted as a brake against the first web reel (3), the second supporting drum (9) is caused to move horizontally and vertically until it comes into contact with the second web reel (3) and starts to support the second web reel (3).

14. The method according to claim 1, wherein, at least from the point in time at which the web reel (3) has reached 25% of its final diameter until at least the point in time at which the web reel (3) has reached 90% of its final diameter, the second supporting drum (9) is caused to move in the horizontal direction during winding as the spool (2) moves such that the position of the second supporting drum in the horizontal direction (9) remains constant in relation to that of the spool (2) of the web reel (3) that is being wound.

15. The method according to claim 14, wherein the spool (2) of the web reel (3) that is being wound rotates about an axis of rotation and the second supporting (9) drum rotates about an axis of rotation and wherein the axes of rotation of the spool (2) and the second supporting drum (9) are kept in the same vertical plane at least from the point in time at which the web reel (3) has reached 25% of its final diameter until at least the point in time at which the web reel (3) has reached 90% of its final diameter.

16. The method according to claim 1, wherein, when a first web reel (3) that is being wound has reached a predetermined size and it is time to start winding of a second web reel (3), the first supporting drum (4) is moved vertically upwards, a new reel spool (2) for the second web reel is caused to move into a position in which it is supported from below by the first supporting drum (4).

17. A winding machine (1) for winding a web (W) of tissue paper or a non-woven material onto spools (2) to form a succession of web reels on the spools (2), the winding machine (1) comprising:

- a first supporting drum (4) arranged to act against a web reel (3) in a winding nip (5), the first supporting drum (4) being moveable upwards and downwards in the vertical direction,
- a first actuator (6) functionally connected to the first supporting drum (4) to be capable of moving the first supporting drum (4) in the vertical direction,
- a guide rail structure (7) along which web reels (3) can move in a horizontal direction as their diameter increases,
- a second supporting drum (9) arranged to be capable of acting against the web reel (3) and form a nip (10) against the web reel (3), the second supporting drum (9) being moveable both horizontally and vertically, the second supporting drum (9) being either functionally connected to a second actuator (11) that is capable of causing the second supporting drum (9) to move vertically and horizontally or the second supporting drum (9) being functionally connected to the first actuator such that the first actuator (6) can cause the second supporting drum (9) to move vertically and horizontally,
- a logic control unit (13) connected to the first actuator (6) and capable of controlling the first actuator (6) and at least one winding nip force sensor (14) arranged to measure the force in the winding nip (5) and send a signal to the logic control unit (13) which is indicative of the force in the winding nip (5), wherein the logic control unit (13) comprises software with an instruction to compare a set value for the winding nip force in the winding nip (5) with the signal from the at least one winding nip force sensor (14) and send an instruction to the first actuator (6) to move the first supporting drum (4) in the direction necessary to correct any deviation from the set force if the signal from the winding force nip sensor (14) indicates that the winding nip force in the winding nip (5) deviates from set force or is outside the range of a predetermined lower value and a predetermined higher value for said winding force.

18. The winding machine (1) according to claim 17, wherein the predetermined lower and higher values are set in relation to a fixed set value for the force in the winding nip (5).

19. The winding machine (1) according to claim 17, wherein the predetermined upper and lower values for the force in the winding nip (5) change during winding as a function of the web diameter and wherein the diameter is calculated by the logic control unit (13) as a function of machine speed, time and web thickness.

20. The winding machine (1) according to claim 17, wherein the machine (1) further comprises at least one nip force sensor (15) arranged to measure the force in the nip (10) between the second supporting drum (9) and the web reel (3) and to send a signal to the logic control unit (13) which is indicative of the nip force between the second supporting drum (9) and the web reel (3), and wherein the logic control unit (13) comprises software with an instruction to compare a set value for the force in nip between with the signal from the at least one nip force sensor (15) and send an instruction to an actuator to move the second supporting drum (9) if the signal from the sensor (15) indicates that the nip force is outside the range of a predetermined lower value and a predetermined higher value.

21. The winding machine (1) according to claim 17, wherein the machine further comprises a cutting device (16) for cutting the web (W) when a new web reel (3) is to be wound.

22. The winding machine (1) according to claim 17, wherein the logic control unit (13) comprises software with an instruction to cause the nip force in the nip (10) between the web reel (3) and the second supporting drum (9) to increase during winding by an amount which is equal to or greater than 15% and equal to or less than 30% of the nip force at the beginning of the winding from the beginning of the winding of a web reel (3) to the end of the winding when the web reel has reached its final diameter.

* * * * *